US009797580B2

(12) United States Patent
Quinlan et al.

(10) Patent No.: US 9,797,580 B2
(45) Date of Patent: Oct. 24, 2017

(54) LED LIGHT FIXTURE

(75) Inventors: Jeffrey Mansfield Quinlan, Covington, GA (US); Mark Anthony Hand, Covington, GA (US); Forrest Starnes McCanless, Oxford, GA (US); John T. Mayfield, III, Loganville, GA (US)

(73) Assignee: ABL IP Holding LLC, Decatur, GA (US)

( * ) Notice: Subject to any disclaimer, the term of this patent is extended or adjusted under 35 U.S.C. 154(b) by 717 days.

(21) Appl. No.: 12/785,937

(22) Filed: May 24, 2010

(65) Prior Publication Data

US 2011/0286214 A1 Nov. 24, 2011

(51) Int. Cl.

| | |
|---|---|
| ***F21V 1/00*** | (2006.01) |
| ***F21V 19/00*** | (2006.01) |
| ***F21S 8/04*** | (2006.01) |
| *F21Y 105/12* | (2016.01) |
| *F21Y 105/10* | (2016.01) |
| *F21Y 103/10* | (2016.01) |
| *F21Y 115/10* | (2016.01) |

(52) U.S. Cl.

CPC ..... *F21V 19/003* (2013.01); *F21S 8/04* (2013.01); *F21Y 2103/10* (2016.08); *F21Y 2105/10* (2016.08); *F21Y 2105/12* (2016.08); *F21Y 2115/10* (2016.08)

(58) Field of Classification Search

CPC ..... H04H 60/31; F21S 8/04; F21Y 2101/02; F21Y 2103/003

USPC ..... 362/235, 223

See application file for complete search history.

(56) References Cited

U.S. PATENT DOCUMENTS

| | | | | |
|---|---|---|---|---|
| 7,229,192 | B2 | 6/2007 | Mayfield, III et al. | |
| 7,261,435 | B2 | 8/2007 | Gould et al. | |
| 8,425,101 | B2 | 4/2013 | Boonekamp | |
| 8,523,383 | B1 * | 9/2013 | Grigore et al. | 362/221 |
| 2003/0156416 | A1 * | 8/2003 | Stopa et al. | 362/294 |
| 2004/0263073 | A1 * | 12/2004 | Baroky et al. | 313/512 |
| 2007/0002565 | A1 * | 1/2007 | Han et al. | 362/240 |
| 2007/0177380 | A1 * | 8/2007 | Schultz et al. | 362/249 |
| 2007/0211457 | A1 * | 9/2007 | Mayfield et al. | 362/223 |

(Continued)

FOREIGN PATENT DOCUMENTS

AU 2008200028 7/2009

OTHER PUBLICATIONS

Chip-on-Board (COB), http://www.siliconfareast.com/cob.htm, Copyright 2005, pp. 1-2.

(Continued)

*Primary Examiner* — Donald Raleigh
*Assistant Examiner* — Jacob R Stern
(74) *Attorney, Agent, or Firm* — Kilpatrick Townsend & Stockton LLP

(57) ABSTRACT

Light fixtures for illuminating spaces that use light emitting diode-based light sources and that incorporate chip on board technology that enables the light emitting diode to be mounted directly on a portion of the light fixture. In some embodiments, the light fixture includes a reflector assembly onto which the light emitting diode is directly mounted. In other embodiments, the reflector assembly includes an aperture that receives a board having chip on board technology onto which the light emitting diode is directly mounted. In some embodiments, the light fixture also includes a diffuser for diffusing the light emanating from the light emitting diodes.

20 Claims, 5 Drawing Sheets

(56) References Cited

U.S. PATENT DOCUMENTS

| | | | | |
|---|---|---|---|---|
| 2009/0290346 | A1* | 11/2009 | Ogawa et al. | 362/249.01 |
| 2009/0303711 | A1* | 12/2009 | Remus et al. | 362/234 |
| 2010/0002433 | A1* | 1/2010 | Liu | 362/235 |

OTHER PUBLICATIONS

Office Action for Canadian Application No. 2,740,437, mailed Jan. 14, 2013.

* cited by examiner

LED LIGHT FIXTURE

FIELD OF THE INVENTION

The invention generally relates to light fixtures that use light emitting diodes and that incorporate chip-on-board technology to enable the light emitting diodes to be mounted directly on a portion of the fixture.

BACKGROUND OF THE INVENTION

Various types of light fixtures are known. Traditional light fixtures presently used in a typical office environment comprise a troffer with at least one fluorescent lamp and a lens having prismatic elements for distributing the light. Typical light fixtures may also use parabolic reflectors to provide a desired light distribution. The fluorescent lamp has long been the light source of choice among lighting designers in many commercial applications, particularly for indoor office lighting. A description of such a fluorescent light fixture may be found in U.S. Pat. Nos. 7,229,192 and 7,261,435, the entire contents of both of which are hereby incorporated by reference.

For many years the most common fluorescent lamps for use in indoor lighting have been the linear T5 (⅝ inch diameter), T8 (1 inch diameter), and the T12 (1½ inch diameter). Such bulbs are inefficient and have a relatively short lamp life. Thus, efforts have been made to identify suitable alternative illumination sources for indoor office lighting applications. Light emitting diodes ("LEDs") have been identified as one alternative to traditional fluorescent bulbs.

An LED typically includes a diode mounted onto a die or chip, where the diode is surrounded by an encapsulant. The die is connected to a power source, which, in turn, transmits power to the diode. An LED used for lighting or illumination converts electrical energy to light in a manner that results in very little radiant energy outside the visible spectrum. Thus, LEDs are extremely efficient, and their efficiency is rapidly improving. For example, the lumen output obtained by 20 LEDs may soon be obtained by 10 LEDs.

Conventional light fixtures that use LEDs as the light source utilize a separate printed circuit board ("PCB") that is pre-populated with LEDs wired to the PCB. During assembly of the light fixture, the PCB (with LEDs mounted thereon) is then fastened to the light fixture housing using either multiple screws or other suitable fasteners. This process requires that PCBs be ordered in advance and inventoried prior to assembly, which increases the length of the production cycle for each finished light fixture.

Moreover, the use of a separate circuit board that then must be attached to a portion of the light fixture also increases product assembly time and decreases thermal conductivity between the LEDs and the light fixture housing. Because there is decreased thermal contact between the LEDs and the housing of the light fixture, the use of intermediate conductive materials is often required. All of this leads to increased expense and decreased efficiency.

Thus, there is a need for a light fixture that utilizes LEDs as the light source and that is configured so that the LEDs are able to be directly mounted to a portion of the housing of the light fixture.

SUMMARY OF THE INVENTION

In certain embodiments there is provided a light fixture that incorporates chip-on-board ("COB") technology whereby at least one LED is mounted directly to a fixture component, such as, but not limited to, the reflector. In other embodiments, at least one LED is mounted to a separate board that is coupled to the fixture.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the following appended figures, in which use of like reference numerals in different features is intended to illustrate like or analogous components.

DETAILED DESCRIPTION OF THE INVENTION

Figure 1:
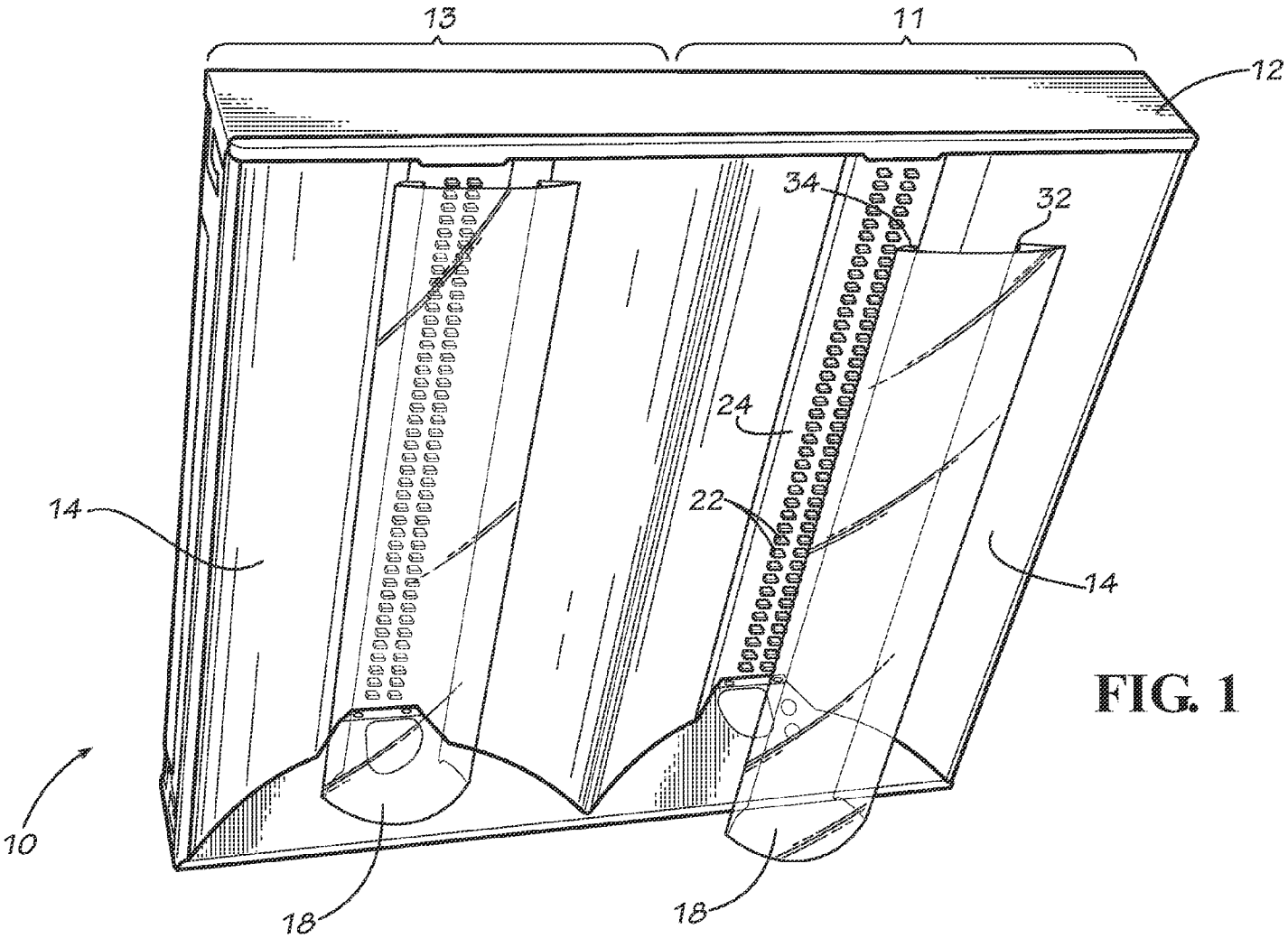
FIG. 1 is a partially exploded bottom perspective view of a light fixture according to one embodiment of the present invention.
Figure 2:
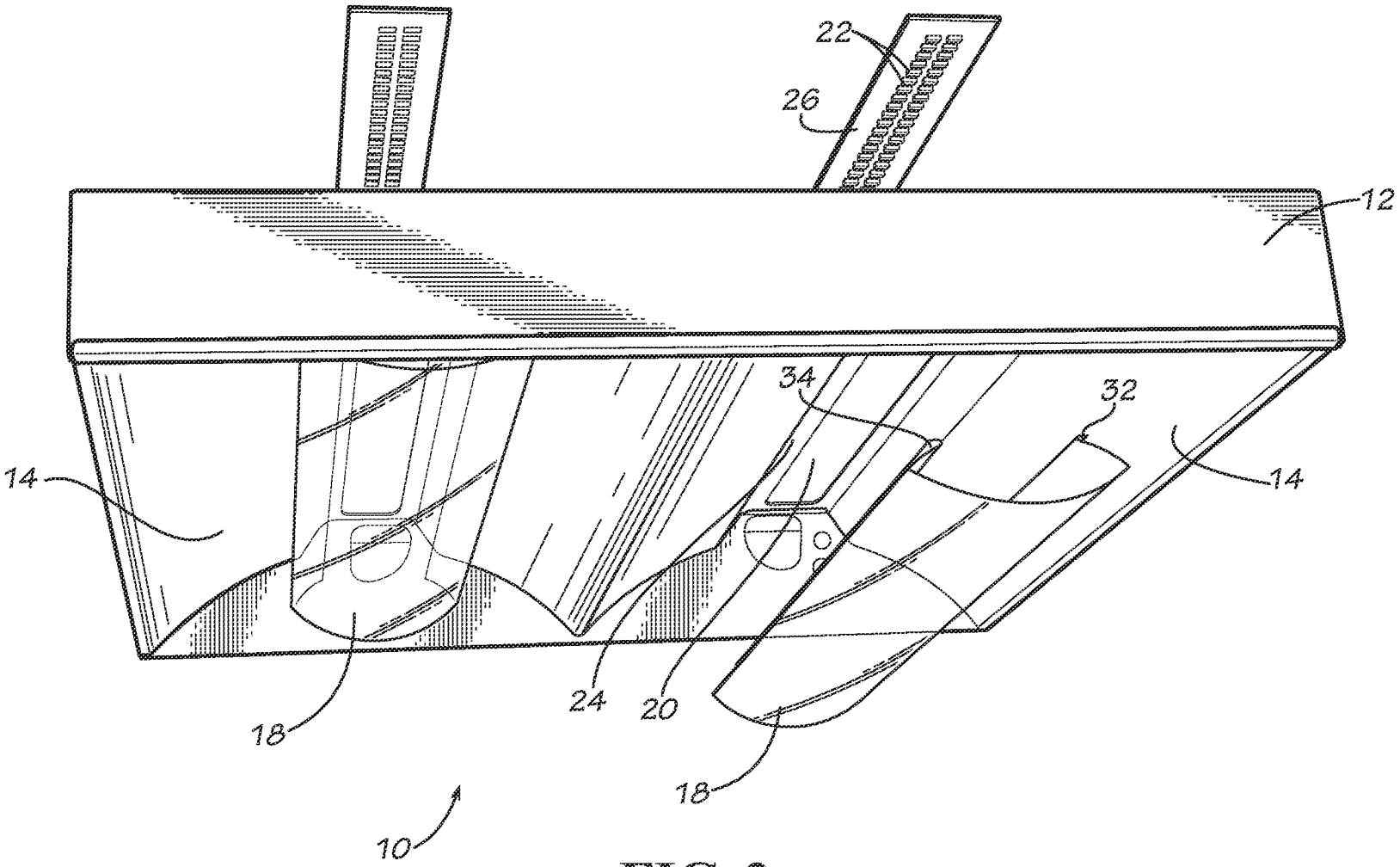
FIG. 2 is a partially exploded bottom perspective view of a light fixture according to another embodiment of the present invention.

FIG. 1 illustrates a light fixture 10 according to one embodiment of the invention. Light fixture 10 comprises a housing 12, at least one reflector assembly 14, and at least one diffuser 18. FIG. 1 illustrates a two-cell light fixture 10 having a first cell 11 and a second cell 13, but one of skill in the art would understand that light fixture 10 alternatively could have only one cell or more than two cells. The various embodiments of this invention will be described generally in relation to a single cell of the illustrated two-cell light fixture.

As shown in FIG. 1, reflector assembly 14 includes a bottom portion 24. Individual LEDs 22 are mounted directly on an underside portion 24 of reflector assembly 14 using what is known in the art as chip on board ("COB") technology, or direct chip attachment. Specifically, the LEDs are soldered or otherwise affixed to the underside portion 24 and copper traces are printed directly on the underside portion 24 of reflector assembly 14 to electrically interconnect the LEDs. Such direct attachment to the fixture streamlines the manufacturing process by avoiding the need to first mount the LEDs on a PCB and then subsequently attach the PCB to the fixture. Moreover, direct attachment of the LEDs to the metal reflector provides a direct path for dissipation of heat generated by the LEDs (and thus improves the transfer of heat from the LEDs) and obviates the need for an intermediate conductive material.

The plurality of individual LEDs 22 serve as a light source for illuminating an area. The LEDs 22 may be single-die or multi-die light emitting diodes, DC or AC, or may be organic light emitting diodes ("O-LEDS"). The LEDs 22 may be white or may include color or multicolor LEDs 22, or may include a variety of different colors of LEDs 22. In some embodiments, LEDs 22 are blue. LEDs 22 may include lenses that surround the LEDs to direct the emitted light. In some embodiments, a phosphor-infused silicon compound (or any suitable polymer infused with phosphor) may be deposited over at least some of the LEDs (more particularly, the lenses covering the LEDs) to alter the color of their emitted light as desired.

Figure 3:
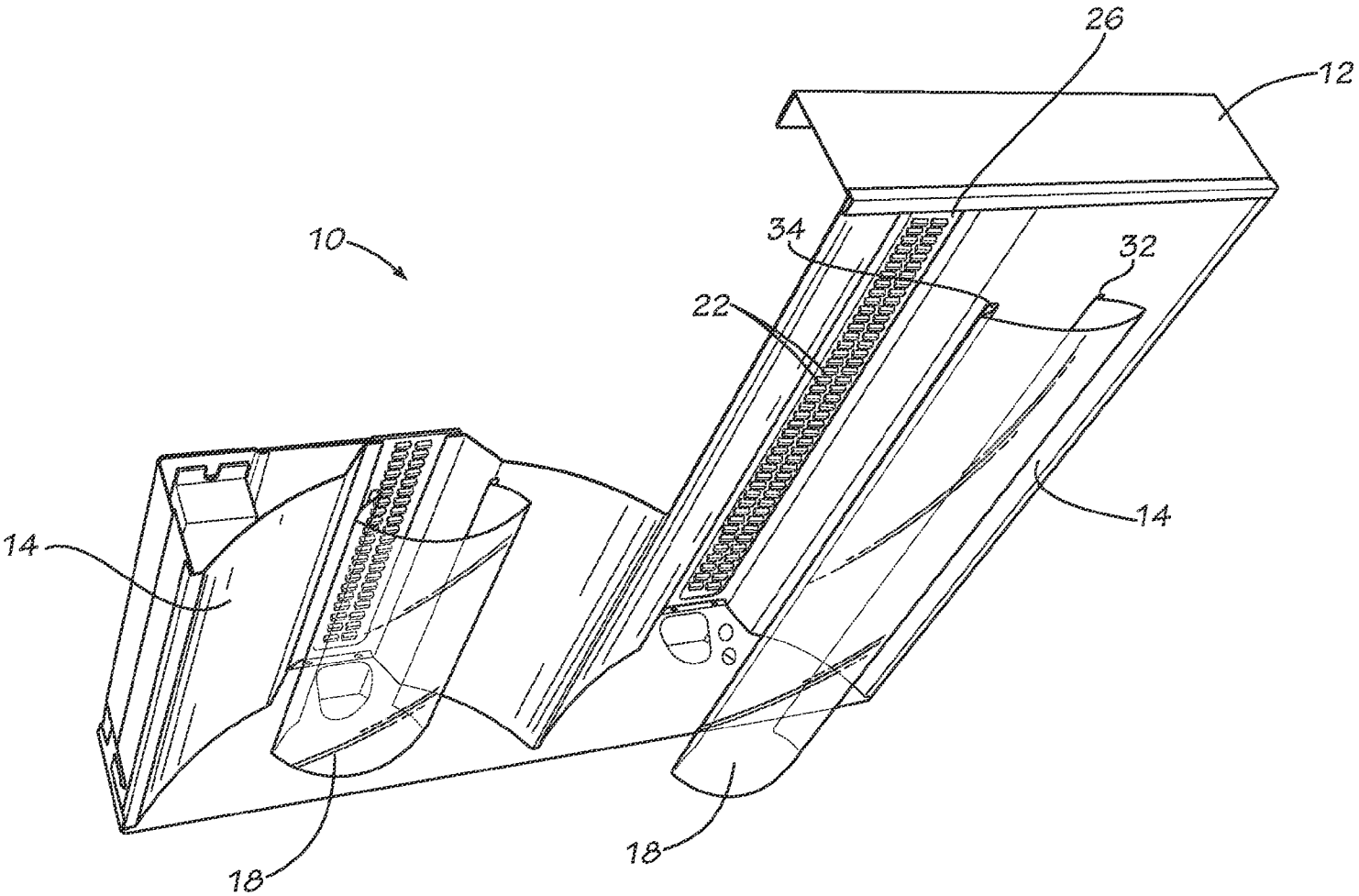
FIG. 3 is partially cut-away, partially exploded bottom perspective view of the light fixture of FIG. 2.
Figure 4:
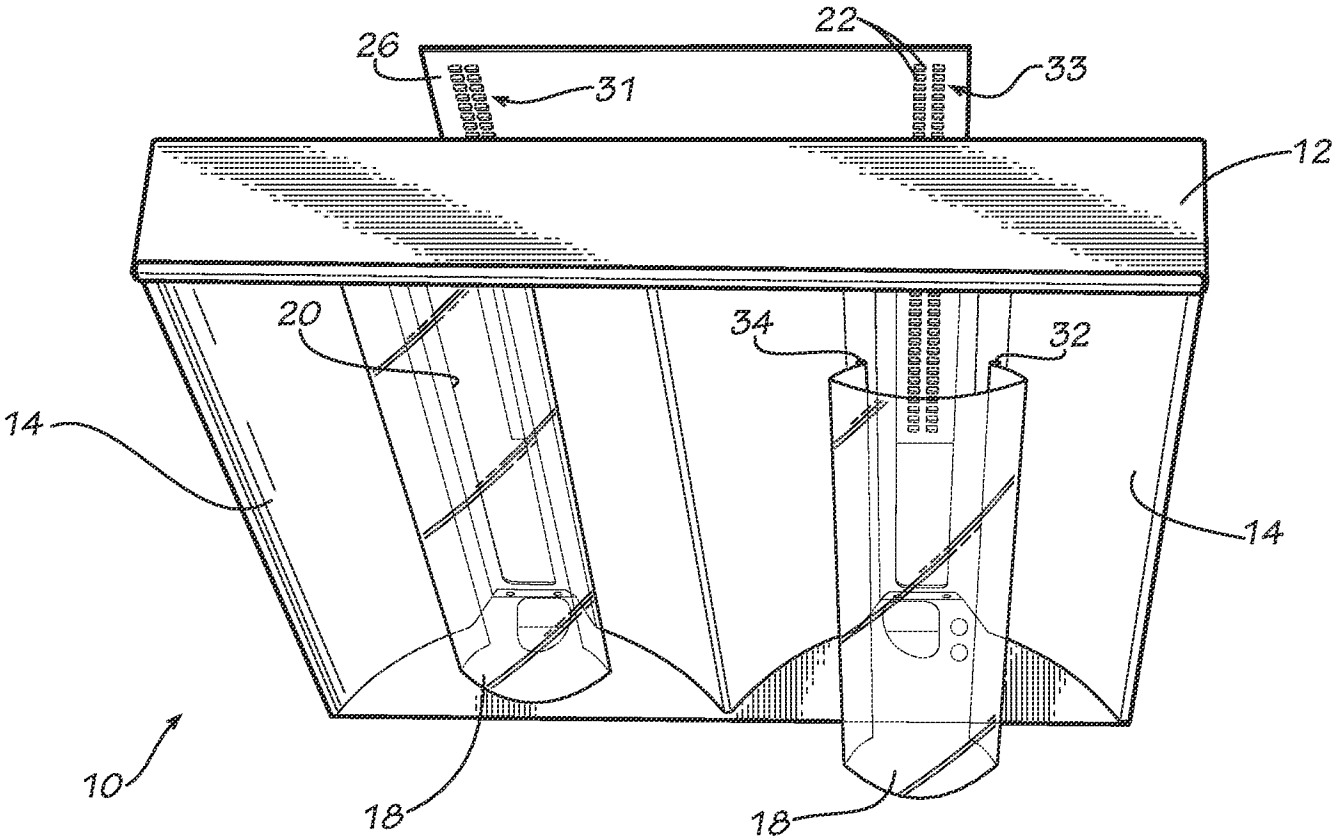
FIG. 4 is a partially exploded bottom perspective view of a light fixture according to another embodiment of the present invention.

FIGS. 3-4 illustrate an alternative embodiment of a light fixture 10. Except where indicated, the light fixture of FIGS. 3-4 is identical to that shown in FIG. 1 and thus FIGS. 3-4 use the same reference numbers to refer to the same structures. The fixture of FIGS. 3-4 differs from that of FIG. 1 in that the LEDs are not mounted directly to the underside portion 24 of the reflector assembly 14. Rather, the LEDs are first mounted directly to a board 26, but in the same manner described above. An aperture 20 is provided through the reflector assembly 14 that is shaped and sized to receive board 26. Specifically, board 26 is positioned between the back of the housing 12 (not shown) and the reflector assembly 14 so that the LEDs 22 align with the aperture 20 in the reflector assembly 14. Board 26 is mounted to the reflective assembly 14 using any suitable mechanical means. When the board 26 is so positioned relative to the reflector assembly 14, light from the LEDs is emitted from the fixture the same way light is emitted from the fixture of FIG. 1. In some embodiments, board 26 is comprised of metal or any other suitable thermally conductive material and can be formed of the same material and/or is the same color as the reflector assembly 14.

Figure 5:
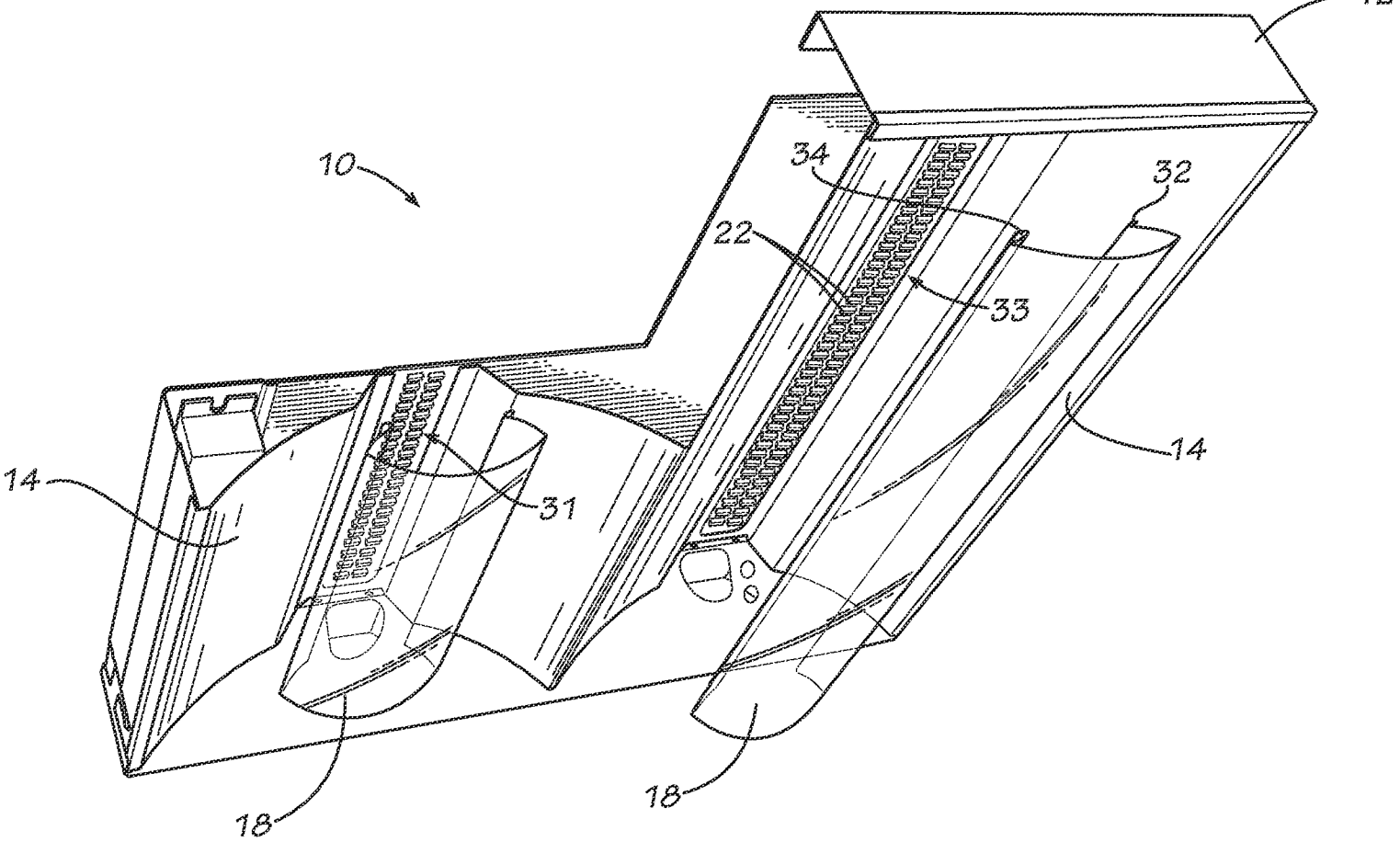
FIG. 5 is a partially cut-away, partially exploded bottom perspective view of the light fixture of FIG. 4.

FIG. 4 illustrates a partial cut-away view of light fixture 10 with board 26 assembled therein. The board 26 may be of any size and shape and is not limited to the relatively narrow boards shown in FIG. 4. Rather, it may be desirable to use a board with wider or longer dimensions to enhance heat dissipation. Moreover, a separate board need not be provided for each cell in the fixture. Rather, as shown in FIG. 5, sets 31 and 33 of LEDs 22 may be mounted on a single board 26 that can be positioned relative to the reflector assemblies 14 so that each set 31, 33 of LEDs 22 aligns with a cell aperture 20. Again, use of a single, larger board may be desirable to improve the heat transfer properties of the fixture.

People of skill in the art would easily appreciate that other configurations than those illustrated in the Figures may be employed. By way only of example, as one alternative to the light fixture illustrated in FIGS. 3-4, instead of being mounted on a separate board, the LEDs 22 may be attached directly to the underside of the back of the housing 12 so that light from the LEDs 22 is emitted through the aperture 20 in the reflector assembly 14. As another non-limiting embodiment, the board 26 itself may form the back of the housing 12. As yet another non-limiting embodiment, the board 26 may be affixed above the back of the housing 12 and apertures 20 may be provided in both the housing 12 and the reflector assembly 14 so that the LEDs 22 align with the apertures in the reflector assembly 14 and the housing 12.

While the plurality of LEDs 22 are shown in the embodiments as extending in two substantially parallel rows, one of skill in the art will recognize that the LEDs may be positioned in any suitable configuration on a reflector assembly 14 or board 26.

Using a portion of the light fixture 10 as the carrier for the COB technology allows for fast programmable application of the LEDs onto the light fixture 10 without manual labor and without the possibility of programming errors. Using a light fixture 10 having COB technology is particularly well suited for an automated high speed production process where the quantity and characteristics of the LEDs used as the light source may be programmed into the light fixture 10 as the fixture 10 is being built and assembled.

In the various embodiments, light emanating from the LEDs 22 is diffused by diffuser 18 that is positioned between the LEDs 22 and the area to be illuminated. Diffuser 18 may have any shape including curved, rectilinear, parabolic, or any other appropriate shape to diffuse light emitted from the LEDs 22 to provide an aesthetically pleasing appearance. Diffuser 18 may be formed of plastic or any other suitable material that allows a sufficient amount of light to pass through the diffuser. Diffuser 18 is connected to reflector assembly by any appropriate mechanical or chemical means. In some embodiments, as shown in the Figures, diffuser 18 has arms 32, 34 that snap-fit over the edges of the reflector assembly. In other embodiments, diffuser 18 may be attached to the reflector assembly using mechanical fasteners.

The foregoing is provided for purposes of illustration and disclosure of embodiments of the invention. It will be appreciated that those skilled in the art, upon attaining an understanding of the foregoing may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

We claim:

1. A light fixture for illuminating an architectural space comprising:

(a) a housing comprising a housing cavity;

(b) a heat dissipater having an underside comprising at least one mounting surface, wherein the heat dissipater is positioned within the housing cavity such that the at least one mounting surface is recessed entirely within the housing cavity;

(c) a plurality of light emitting diodes mounted directly onto the at least one mounting surface without a printed circuit board interposed between the plurality of light emitting diodes and the at least one mounting surface, wherein the plurality of light emitting diodes are recessed entirely within the housing cavity; and (d) traces printed on the at least one mounting surface to electrically interconnect the plurality of light emitting diodes.

2. The light fixture of claim 1, wherein the heat dissipater further comprises at least one pair of curved reflective surfaces, wherein the at least one mounting surface is interposed between the curved reflective surfaces of the at least one pair of curved reflective surfaces and wherein the curved reflective surfaces of the at least one pair of curved reflective surfaces extend from the at least one mounting surface in a direction toward the architectural space to an extent beyond the plurality of light emitting diodes so as to be positioned to receive and reflect light emitted by the plurality of light emitting diodes.

3. The light fixture of claim 1, wherein at least one of the plurality of light emitting diodes further comprises a lens comprising a phosphor-infused polymer.

4. The light fixture of claim 1, wherein the housing further comprises opposing end walls separated by a distance and opposing side walls separated by a distance, wherein the opposing end walls and the opposing side walls define the housing cavity such that the housing cavity extends entirely across the distance between the opposing end walls and the distance between the opposing side walls.

5. The light fixture of claim 4, wherein the heat dissipater extends continuously and entirely across the distance between the opposing side walls and the distance between the opposing end walls.

6. The light fixture of claim 2, wherein the at least one mounting surface comprises an elongated channel near an upper portion of the housing.

7. The light fixture of claim 2, wherein the curved reflective surfaces of the at least one pair of curved reflective surfaces extend within the housing cavity parallel to the at least one mounting surface and wherein the curved reflective surfaces of the at least one pair of curved reflective surfaces curve downwardly from the at least one mounting surface towards a bottom portion of the housing.

8. The light fixture of claim 2, wherein the at least one pair of curved reflective surfaces is formed integrally with the at least one mounting surface.

9. The light fixture of claim 2, wherein the at least one pair of curved reflective surfaces is recessed entirely within the housing cavity.

10. The light fixture of claim 6, wherein:

the at least one mounting surface comprises a first mounting surface and a second mounting surface that extends within the housing cavity parallel to the first mounting surface;

the at least one pair of curved reflective surfaces comprise a first pair of curved reflective surfaces and a second pair of curved reflective surfaces; and the first mounting surface is interposed between the reflective surfaces of the first pair of curved reflective surfaces and the second mounting surface is interposed between the curved reflective surfaces of the second pair of curved reflective surfaces.

11. The light fixture of claim 10, wherein a central portion of the heat dissipater comprises a crest where an edge of one of the curved reflective surfaces of the first pair of curved reflective surfaces meets an edge of one of the curved reflective surfaces of the second pair of curved reflective surfaces.

12. A method of manufacturing a light fixture, the method comprising:

(a) providing a light fixture comprising:

(i) a housing comprising a housing cavity; and (ii) a heat dissipater having an underside comprising at least one mounting surface, wherein the heat dissipater is positioned within the housing cavity such that the at least one mounting surface is recessed entirely within the housing cavity; and (b) directly attaching a plurality of light emitting diodes onto the at least one mounting surface without a printed circuit board interposed between the plurality of light emitting diodes and the at least one mounting surface such that the plurality of light emitting diodes are recessed entirely within the housing cavity.

13. The method of manufacturing a light fixture of claim 12, wherein:

the at least one mounting surface comprises a first mounting surface and a second mounting surface that extends within the housing cavity parallel to the first mounting surface;

the heat dissipater further comprises a first pair of curved reflective surfaces and a second pair of curved reflective surfaces; and the first mounting surface is interposed between the curved reflective surfaces of the first pair of curved reflective surfaces and the second mounting surface is interposed between the curved reflective surfaces of the second pair of curved reflective surfaces.

14. The method of manufacturing a light fixture of claim 12, further comprising printing traces directly on the at least one mounting surface to electrically interconnect the plurality of light emitting diodes.

15. The method of manufacturing a light fixture of claim 12, wherein the heat dissipater further comprises at least one pair of curved reflective surfaces, wherein the at least one mounting surface is interposed between the curved reflective surfaces of the at least one pair of curved reflective surfaces and wherein the curved reflective surfaces of the at least one pair of curved reflective surfaces extend from the at least one mounting surface beyond the plurality of light emitting diodes so as to be positioned to receive and reflect light emitted by the plurality of light emitting diodes.

16. The method of manufacturing a light fixture of claim 12, wherein the housing further comprises opposing end walls separated by a distance and opposing side walls separated by a distance, wherein the opposing end walls and the opposing side walls define the housing cavity such that the housing cavity extends the distance between the opposing end walls and the distance between the opposing side walls.

17. The method of manufacturing a light fixture of claim 15, wherein the at least one pair of curved reflective surfaces is formed integrally with the at least one mounting surface.

18. The method of manufacturing a light fixture of claim 15, wherein the at least one pair of curved reflective surfaces is recessed entirely within the housing cavity.

19. The light fixture of claim 16, wherein the heat dissipater extends continuously and entirely across the distance between the opposing side walls and the distance between the opposing end walls.

20. A light fixture for illuminating an architectural space comprising:

(a) a housing comprising an upper portion, a lower portion, and a housing cavity having an opening proximate the lower portion;

(b) a heat dissipater positioned within the housing cavity, the heat dissipater comprising at least one mounting surface, a first curved reflective surface extending from a first side of the at least one mounting surface, and a second curved reflective surface extending from a second side of the at least one mounting surface opposite the first side, wherein:

i. the at least one mounting surface, the first curved reflective surface and the second curved reflective surface are positioned entirely within the housing cavity;

ii. the at least one mounting surface is positioned more proximate the upper portion of the housing than the first and second curved reflective surfaces; and iii. the first and second curved reflective surfaces extend from the at least one mounting surface towards the lower portion of the housing;

(c) a plurality of light emitting diodes mounted directly onto the at least one mounting surface without a printed circuit board interposed between the plurality of light emitting diodes and the at least one mounting surface, wherein the plurality of light emitting diodes are recessed entirely within the housing cavity and wherein the first and second curved reflective surfaces extend from the at least one mounting surface in a direction toward the architectural space to an extent beyond the plurality of light emitting diodes so as to be positioned to receive and reflect light emitted by the plurality of light emitting diodes; and (d) traces printed on the at least one mounting surface to electrically interconnect the plurality of light emitting diodes.

* * * * *